US005812035A

United States Patent [19]

Fleeger et al.

[11] Patent Number: 5,812,035

[45] Date of Patent: Sep. 22, 1998

[54] METHODS OF PRODUCING MICROWAVE POWER DIVIDERS AND COMBINERS HAVING SPLIT TERMINATING RESISTORS WITH EQUALLY MATCHED RESISTOR SECTIONS

[75] Inventors: Robert G. Fleeger, Fullerton; Ron K. Nakahira, La Palma, both of Calif.

[73] Assignee: Raytheon Company, Lexington, Mass.

[21] Appl. No.: 769,554

[22] Filed: Dec. 19, 1996

[51] Int. Cl.[6] ..... H01P 5/12

[52] U.S. Cl. ..... 333/128; 333/22 R; 29/620

[58] Field of Search ..... 333/127, 128, 333/22 R; 29/610.1, 612, 620

[56] References Cited

U.S. PATENT DOCUMENTS 4,032,881 6/1977 Singleton ..... 29/620 X 5,150,084 9/1992 Asa et al. ..... 333/128

*Primary Examiner*—Paul Gensler

*Attorney, Agent, or Firm*—Leonard A. Alkov; Glenn H. Lenzen, Jr.

[57] ABSTRACT

A method of producing a microwave power divider or combiner having equally matched sections of a split terminating resistor. The method initially matches the resistance value of both sections of the split terminating resistor by identifying which section has a lower resistance value. The ratio of the resistance values of the two sections is determined. The section having the lower resistance value is then trimmed until it is equal to the other. The termination sections may then be equally trimmed to provide a desired final resistance value for the terminating resistor.

8 Claims, 2 Drawing Sheets

METHODS OF PRODUCING MICROWAVE POWER DIVIDERS AND COMBINERS HAVING SPLIT TERMINATING RESISTORS WITH EQUALLY MATCHED RESISTOR SECTIONS

BACKGROUND

The present invention relates generally to microwave power dividers and combiners, and more particularly, to methods of manufacturing microwave power dividers and combiners having split terminating resistors.

Prior art relating to the present invention is disclosed in a paper by E. J. Wilkinson entitled "An N-way Power Divider", IRE Transactions, Microwave Theory Tech, volume MTT-8, pages 116–118, January 1960, and a paper by S. B. Cohn entitled "A Class of Broadband TEM Mode Hybrids", published in IEEE Transactions Microwave Theory and Techniques, MTT-16, pages 110–116, February 1968, for example. The basic issue with the microwave power divider designs disclosed in these papers relates to problems in manufacturing the termination resistance to a tight tolerance.

For typical three port power dividers (or combiners), such as are shown in the drawing figures, the optimum termination resistance is typically twice the value of the resistance at the ports . This is important because of the interaction between the termination resistance and the maximum achievable isolation between the ports of the circuit. This makes the quality of the termination critical in achieving a high manufacturing yield. A deviation of one percent reduces the achievable isolation by several dB.

Printing precision thick film resistor values is difficult, and in most applications, the requisite precision is achieved by printing an initial value of about 80 % of the desired value, then measuring the resistance while removing small amounts of the resistive material until the resistance has increased to the desired value. This technique cannot be used to measure and adjust these terminating resistors because the arms of a conventional power divider have a DC short circuit across it.

In addition, because the conventional design does not allow pretesting the substrate, the other components are assembled with a part of unknown quality and performance. This is especially important for power divider structures that are buried within a dielectric material such as low temperature cofired ceramic as an integral part of complex microwave assemblies because the resulting yield loss cost of value added subassemblies containing microwave integrated circuit components is very high.

The yield of Wilkinson type power dividers is dependent upon manufacturing the thick film terminating resistor to a tight tolerance. Without a means for measuring and adjusting the final value, the associated yield loss is much greater, or the port isolation is much lower than if standard resistor fabrication techniques could be used.

More particularly, the yield of Wilkinson-type power dividers is primarily determined by the ability to print an accurate terminating resistor typically in the range of 100 ohms. Trimming this resistor to a precise value is virtually impossible because arms of the power divider have a DC short across it. Yield loss associated with conventional power dividers is much higher than if the termination could be measured and trimmed using standard resistor fabrication techniques. In addition, these conventional terminating resistor designs do not allow pretesting or trimming of the substrate prior to component installation or assembly. This results in expensive yield losses of high value-added subassemblies which may contain expensive integrated circuit components that fail post-assembly testing because of an inaccurate termination reducing the port isolation.

Accordingly, it is an objective of the present invention to provide for improved methods of manufacturing microwave power dividers and combiners employing a split terminating resistor. It is a further objective of the present invention to provide for methods of manufacturing microwave power dividers and combiners having a split terminating resistor that matches the resistance value of both sections of the split terminating resistor and equally trims the sections to provide a desired final resistance value for the terminating resistor.

SUMMARY OF THE INVENTION

To meet the above and other objectives, the present invention provides for a method of manufacturing high performance microwave multiport power dividers and combiners. The method initially matches the resistance value of both sections of a split termination, or terminating resistor, by identifying which side has a lower resistance value, the ratio of the resistance values of the two sections, and then trims the lower one until it is equal to the other, even though the microwave circuit short circuits them. The termination sections are then equally trimmed to the desired final value.

The method increases the microwave performance of the dividers and combiners, especially in buried multiport designs, by eliminating a primary source of error in the manufacture and measurement of these terminations caused by effects of initial mismatch between two termination sections of a terminating resistor prior to laser trimming. When the manufacturing process is well controlled and other design constraints allow the sections to have substantially equal areas, the mismatch will typically be smaller but unknown. Where the areas cannot be matched or in the case of buried structures where the process capability is lower, the present method provides a means to achieve acceptable yields on high performance designs. The method may also be adapted to inspect substrates incorporating dividers and combiners having central contacts.

The present method enables manufacture of high performance power dividers and combiners buried in multilayer substrates such as low temperature cofired ceramic (LTCC) substrates, as well as surface layer structures, by eliminating the effects of the resistor process variability on these microwave structures. The method allows manufacture of buried structures with terminations accurate to a fraction of a percent.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
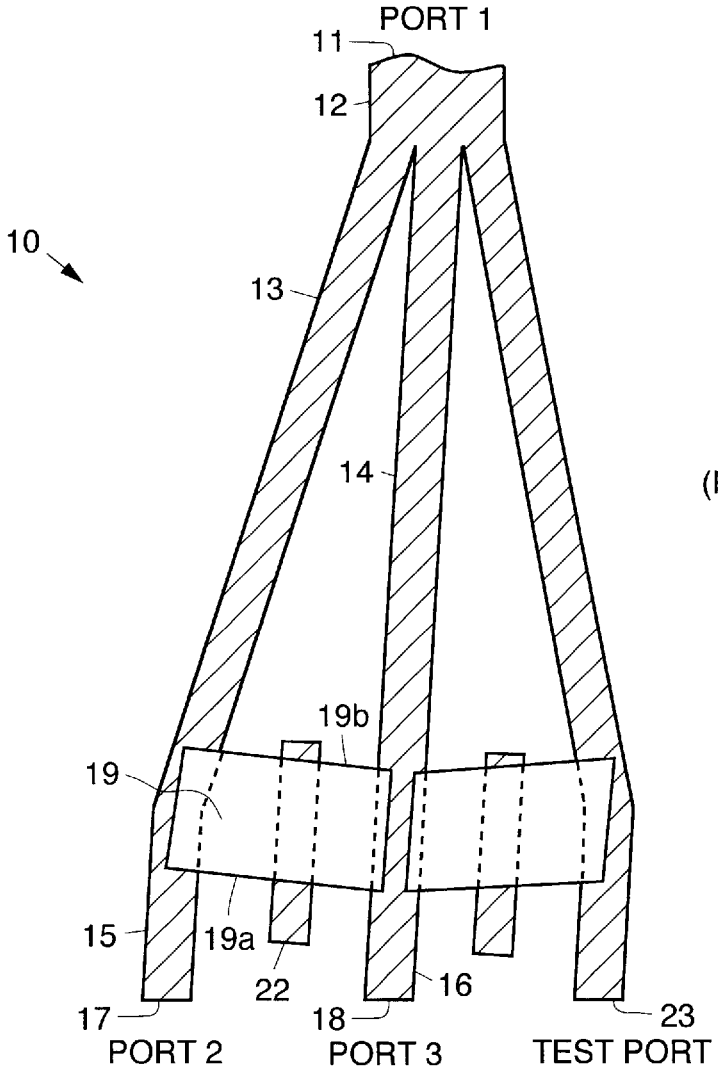
Fig. 1 (PRIOR ART)
FIG. 1 illustrates a microwave power divider that is improved upon by the present invention.

Referring to the drawing figures, FIG. 1 illustrates a portion of a four port (three-way) Wilkinson-type power divider 10 that was developed by the assignee of the present invention over ten years ago and used in a transmit and receive (T/R) module of an antenna array. This power divider 10 is particularly illustrative of the problem that the present invention solves.

The power divider 10 includes a central contact 22 disposed between the traces corresponding to the output path 13, and the second and third impedance paths 15, 16. The terminating resistor 19 is printed so that it overlays the central contact 22, thus forming two resistor sections 19*a*, 19*b*. However, comparing the two resistor sections 19*a*, 19*b* reveals that they are not matched in resistance.

In particular, at the juncture between the first resistor section, the output path 13, and the second impedance path 15, it is seen that the outline of the traces defining the output path 13 and the second impedance path 15 are not parallel to the adjacent edge of the central contact 22. Thus, the two resistor sections 19*a*, 19*b* do not have the same areas and therefore do not have the same impedance value. This is the same for the resistor sections of the opposite side of the power divider 10. In designs where the resistors are cofired within a ceramic structure, the higher overall variability of this process may cause a mismatch between sections 19*a*, 19*b* of the termination, even where the areas of the resistor sections 19*a*, 19*b* are more closely matched than in the example case.

This situation is typical for substantially all terminating resistors 19 fabricated for use in Wilkinson-type power dividers 10 and combiners 10. Using conventional procedures, the various resistor sections 19*a*, 19*b* cannot be trimmed accurately given the design of this power divider 10. This problem is rectified by the present invention.

Figure 2:
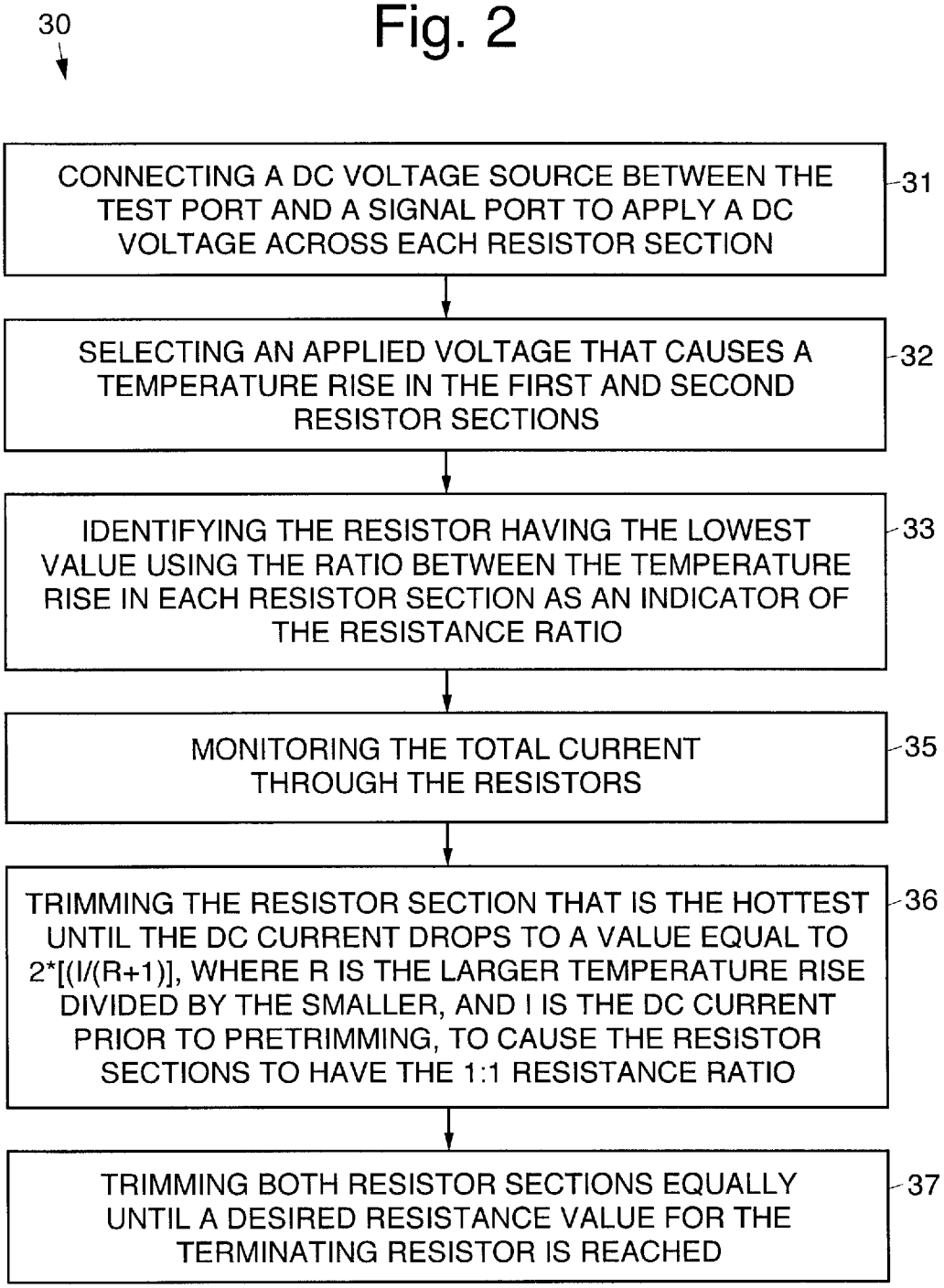
FIG. 2 illustrates one method in accordance with the principles of the present invention.

Referring now to FIG. 2, it illustrates one method 30 in accordance with the principles of the present invention. The method 30 is used to match the impedance values of the resistor sections 19*a*, 19*b* of a power divider 10 or combiner 10 and then trim both resistor sections 19*a*, 19*b* to provide a desired final resistance value.

In accordance with the present method 30, a DC voltage source is connected (31) between the central contact 22 and any of the signal ports 11, 17, 18. This may be achieved by coupling the central contact 22 to a test port 23 by way of a via or high impedance line, for example. Therefore, a DC voltage is identically applied across each resistor section 19*a*, 19*b* of the terminating resistor 19.

Thus, when DC power is applied, the power dissipated by each resistor section 19*a*, 19*b* is a function of its resistance. An applied voltage is selected (32) to cause a reasonable amount of temperature rise in the first and second resistor sections 19*a*, 19*b*. The ratio between the temperature rise in each resistor section 19*a*, 19*b* is used as a proxy or indicator of the formerly unknown resistance ratio to identify (33) the resistor section 19*a*, 19*b* having the lowest value.

The total current through the resistor section 19*a*, 19*b* is monitored (35) (using an ammeter, for example) and the section 19*a*, 19*b* of the resistor that was the hottest (having the lowest resistance) is tried (36) until the DC current drops to $2*[(I/(R+1)]$, where R is the larger temperature rise divided by the smaller temperature rise, and I is the DC current prior to trimming. The formula $2*[(I/(R+1)]$ defines a point where the current drops to the value that would occur if the resistance of both sections 19*a*, 19*b* were equal, given the initial pretrimming current and the calculated resistance ratio.

This trimming operation accurately prematches both resistor sections 19*a*, 19*b* to a 1:1 resistance ratio corresponding to the ideal error free condition where the total resistance exactly equals four times the measured value. Then, both resistor sections 19*a*, 19*b* are trimmed (37) equally until the desired resistance value for the terminating resistor 19 is reached. The resulting total termination resistance will be within the desired value by a fraction of one percent.

The present method 30 may be used for incoming circuit inspection purposes, for example. The method 30 may be used to reveal the percentage mismatch between sections 19*a*, 19*b* of terminating resistors 19 used in the circuits, allowing the uncertainty in the measured value to be computed.

The process flow of the present method 30 is amenable to automated batch processing techniques that are required for high volume products such as transmit and receiver (T/R) modules used in antennas, for example, because the temperature rise measurement and laser trimming are completely separate operations. Since the temperature measurement is ratiometric, inexpensive infrared temperature measuring equipment may be used in lieu of Computherm equipment that was used to develop the present invention, because absolute temperatures are not important.

The only data required for each circuit during the manufacturing process is the temperature ratio R for the terminating resistors 19 of the circuit and identification of the lowest value resistor section 19*a*, 19*b* of each terminating resistor 19. The amount of current applied to the lowest value resistor section 19*a*, 19*b* does not need to be the same as the amount used during the temperature measurement. For example, a trimming station may be used to set the voltage to obtain any convenient value of initial current, say 10 mA, and trim the hottest resistor section (lowest resistance) section 19*a*, 19*b* until the current is reduced to the computed amount.

The following table illustrates measured data for one test prototype substrate processed using the present method 30 that contained a Wilkinson-type power divider 10 having mismatched resistor sections 19*a*, 19*b*. The initial mismatch between the test resistor sections 19*a*, 19*b* was 1.5:1.

| Voltage V | Stage Temperature °C. | ΔT1 °C. | ΔT2 °C. | Calibrated mismatch |
|---|---|---|---|---|
| 2.005 | 45.0 | 7.176 | 4.824 | 1.49 |

Thus, improved methods of manufacturing microwave power dividers and combiners employing a split terminating resistor have been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A method of producing a microwave power divider or combiner having equally matched paths, and wherein the power divider or combiner comprises a first port coupled to a first impedance path that splits along two paths, second and third impedance paths respectively coupled to the two paths, second and third ports coupled to the second and third impedance paths, respectively, a central contact disposed between respective inner edges of the second and third impedance paths, and a terminating resistor overlying the inner edges of the second and third impedance paths and the central contact to form first and second resistor sections, and wherein said method comprises the steps of:

connecting a DC voltage source between the central contact and a signal port to apply a DC voltage across each resistor section;

selecting an applied voltage that causes a temperature rise in the first and second resistor sections;

identifying the resistor having the lowest value using the ratio between the temperature rise in each resistor section as an indicator of the resistance ratio; and trimming the resistor section that is the hottest until the DC current drops to a value that would occur if the resistance of both sections were equal to cause the resistor sections to have 1:1 resistance ratio.

2. The method of claim 1 further comprising the step of:

trimming both resistor sections equally until a desired resistance value for the terminating resistor is reached.

3. The method of claim 1 wherein the step of trimming the resistor section that is the hottest comprises the step of monitoring the total current through the resistor.

4. The method of claim 2 wherein the step of trimming the resistor section that is the hottest comprises the step of monitoring the total current in the resistor sections.

5. The method of claim 2 wherein the step of trimming the resistor section that is the hottest comprises the step of:

trimming the resistor section that is the hottest until the DC current drops to a value equal to 2*[(I/(R+1)], where R is the larger temperature rise divided by the smaller temperature rise, and I is the DC current prior to trimming, to cause the resistor sections to have the 1:1 resistance ratio.

6. A method of producing a microwave power divider or combiner having equally matched paths, and wherein the power divider or combiner comprises a first port coupled to a first impedance path that splits along two paths, second and third impedance paths respectively coupled to the two paths, second and third ports coupled to the second and third impedance paths, respectively, a central contact disposed between respective inner edges of the second and third impedance paths, and a terminating resistor overlying the inner edges of the second and third impedance paths and the central contact to form first and second resistor sections, and wherein said method comprises the steps of:

connecting a DC voltage source between the central contact and a signal port to apply a DC voltage across each resistor section;

selecting an applied voltage that causes a modest temperature rise in the first and second resistor sections;

identifying the resistor having the lowest resistance value using the ratio between the temperature rise in each resistor section as an indicator of the resistance ratio;

trimming the resistor section that is the hottest until the DC current drops to a value that would occur if the resistance of both sections were equal, and therefore cause the resistor sections to have a 1:1 resistance ratio; and trimming both resistor sections equally until a desired resistance value for the terminating resistor is reached.

7. The method of claim 6 wherein the step of trimming the resistor section that is the hottest comprises the step of monitoring the current in the resistor sections.

8. The method of claim 6 wherein the step of trimming the resistor section that is the hottest comprises the step of:

trimming the resistor section that is the hottest until the DC current drops to a value equal to 2*[(I/(R+1)], where R is the larger temperature rise divided by the smaller temperature rise, and I is the DC current prior to trimming, to cause the resistor sections to have the 1:1 resistance ratio.

* * * * *